US010746095B2

(12) United States Patent
Chottiner

(10) Patent No.: US 10,746,095 B2
(45) Date of Patent: Aug. 18, 2020

(54) VARIABLE COMPRESSION RATIO ENGINE WITH HYDRAULICALLY ACTUATED LOCKING SYSTEM

(71) Applicant: Ford Global Technologies, LLC, Dearborn, MI (US)

(72) Inventor: Jeffrey Chottiner, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 19 days.

(21) Appl. No.: 16/254,361

(22) Filed: Jan. 22, 2019

(65) Prior Publication Data

US 2020/0232384 A1 Jul. 23, 2020

(51) Int. Cl.
*F02B 75/04* (2006.01)
*F02D 15/02* (2006.01)

(52) U.S. Cl.
CPC ..... *F02B 75/045* (2013.01); *F02B 75/048* (2013.01); *F02D 15/02* (2013.01)

(58) Field of Classification Search
CPC ..... F02B 75/045; F02B 75/048; F02B 75/04; F02D 15/00; F02D 15/02
See application file for complete search history.

(56) References Cited

U.S. PATENT DOCUMENTS 4,687,348 A * 8/1987 Naruoka ..... F02B 75/044 123/48 B
2015/0176483 A1* 6/2015 Matsuda ..... F02B 75/048 123/48 B

FOREIGN PATENT DOCUMENTS

CN 205638695 U 10/2016
JP 2003322036 A 11/2003

* cited by examiner

*Primary Examiner* — Jacob M Amick
(74) *Attorney, Agent, or Firm* — Geoffrey Brumbaugh McCoy Russell LLP

(57) ABSTRACT

Methods and systems are provided for a VCR engine. In one example, the VCR engine includes a VCR mechanism that mechanically locks the engine pistons at a high compression ratio or a low compression ratio, utilizing locking pins that engage with eccentrics. Movement of the locking pins may be actuated by a valve that controls hydraulic pressure in the VCR mechanism where varying the hydraulic pressure adjusts engagement/disengagement of the locking pins.

20 Claims, 7 Drawing Sheets

VARIABLE COMPRESSION RATIO ENGINE WITH HYDRAULICALLY ACTUATED LOCKING SYSTEM

FIELD

The present description relates generally to methods and systems for a variable compression ratio engine.

BACKGROUND/SUMMARY

In a conventional vehicle engine, a cylinder compression ratio (CR) is fixed, with a piston moving between a consistent top-dead-center (TDC) and bottom-dead-center (BDC) during each combustion cycle. If the CR is set at a low ratio to deliver maximum power during engine operation, the low CR may result in undesirable combustion of excess fuel during light engine loads and speeds. Conversely, if the CR is set at a high ratio to prioritize fuel efficiency, a power output of the engine may be degraded when increased torque is requested.

To mitigate the above issues, an engine may be adapted as variable compression ratio (VCR) engine and equipped with various mechanisms to alter (e.g., mechanically alter) a volumetric ratio between the piston TDC and BDC. Thus the CR may be adjusted as engine operating conditions change. As a non-limiting example, a VCR engine may be adapted with a retrofit VCR system that includes a mechanical piston displacement changing device (e.g., an eccentric) that moves the piston closer to or further from the cylinder head, thereby changing the size of the combustion chambers. Still other engines may mechanically alter a cylinder head volume. The retrofit VCR system may enable reconfiguration of an engine with a fixed compression ratio to have an adjustable compression ratio that is varied according to engine operations, thereby increasing vehicle fuel economy.

In some retrofit VCR systems, the eccentric used to alter the piston position may be controlled by a gear system. The gear system may rotate, and, in turn, rotate the eccentric, leading to variations in piston height. However, friction between components of the gear system may generate undesirable sounds while the gear system rotates, leading to noise, vibration and harshness (NVH) issues. Furthermore, an actuator driving movement of the gear system may be costly, occupying space in an already space-restricted compartment and adding weight to the engine.

One example approach to address the NVH and actuator issues is shown in Chinese Patent Application No. CN 205638695. Therein, a VCR system includes a rod assembly connected to a piston, movement of the rod assembly actuated by an eccentric bushing. The eccentric bushing is coupled to an end of the rod assembly proximate to the piston and distal to a crankshaft. A height of the piston is adjusted by the eccentric bushing and a position of the piston is maintained by a hydraulically actuated locking pin. The engine is adjusted between a low compression ratio state and a high compression ratio state by activation of an oil pump when the piston is at TDC, generating hydraulic pressure in an oil chamber that counters an elastic force of a compression spring, thereby pulling the locking pin out of a first locking hole in the eccentric bushing. The eccentric bushing is allowed to rotate until the piston is at a desired height. The oil pump is deactivated, dissipating the hydraulic pressure and allowing the compression pin to slide the locking pin into a second locking hole. When the locking pin is inserted into the second locking hole of the eccentric bushing, a position of the eccentric bushing and the piston height is maintained. The compression ratio is readily varied between a high ratio and a low ratio without relying on a complex mechanical actuation system.

However, the inventors herein have recognized potential issues with such systems. As one example, coupling the eccentric bushing to the end of the conrod coupled to the piston positions the eccentric bushing at a small end, e.g., smaller than an opposite end, of the conrod. Addition of the eccentric bushing to the small end of the conrod adds reciprocating weight that may lead to mass imbalance during rotation of a crankshaft. Imbalance of masses at the crankshaft may contribute to NVH issues, particularly as high engine speeds. To counter forces resulting from the reciprocating weight, one or more balance shafts may be added to the engine, or, if the engine already has a balance shaft, a size of the balance may be increased. The one or more balance shafts may generate friction that consumes fuel energy to overcome, offsetting fuel economy benefits obtained through implementation of the VCR system and increasing a cost, complexity, and weight of the engine.

In one example, the issues described above may be addressed by a method for a variable compression ratio (VCR) mechanism, including an eccentric with a first detent and a second detent, the first and second detents arranged on opposite faces of the eccentric and positioned 180 degrees relative to one another around a circumference of the eccentric, the eccentric configured to be adjusted between a locked position and an unlocked position, a first locking pin configured to be inserted into the first detent of the eccentric and housed in a first oil chamber, a second locking pin configured to be inserted into the second detent of the eccentric and housed in a second oil chamber, and a valve fluidly coupled to the first oil chamber and the second oil chamber.

In this way, the engine compression ratio may be varied without modifications to the engine block and without inducing NVH issues or implementation of a costly and complex system to actuate adjustment of the compression ratio and provide mass balance to the engine.

As one example, a VCR engine may include eccentrics rotatably coupled to crank pins of a crankshaft. Each of the eccentrics is connected to a piston by a conrod, arranged at an end of the conrod distal to the piston, and extending between the eccentric and a base of the piston. The eccentrics may be adapted with a first slot and a second slot, configured to mate with a first locking pin and a second locking, respectively. The eccentrics may be alternatively locked in a first position by engagement of the first locking pin with first slot or a second position by engagement of the second locking pin with the second slot. The first position and second position correspond to different piston heights, and therefore, different compression ratios. Movement of the locking pins is controlled by hydraulic pressure provided by oil reservoirs, thereby enabling adjustment of the compression ratio using a simple system that does not produce NVH effects or cause mass imbalance in the engine.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 4-8 are shown approximately to scale.

DETAILED DESCRIPTION

Figure 2:
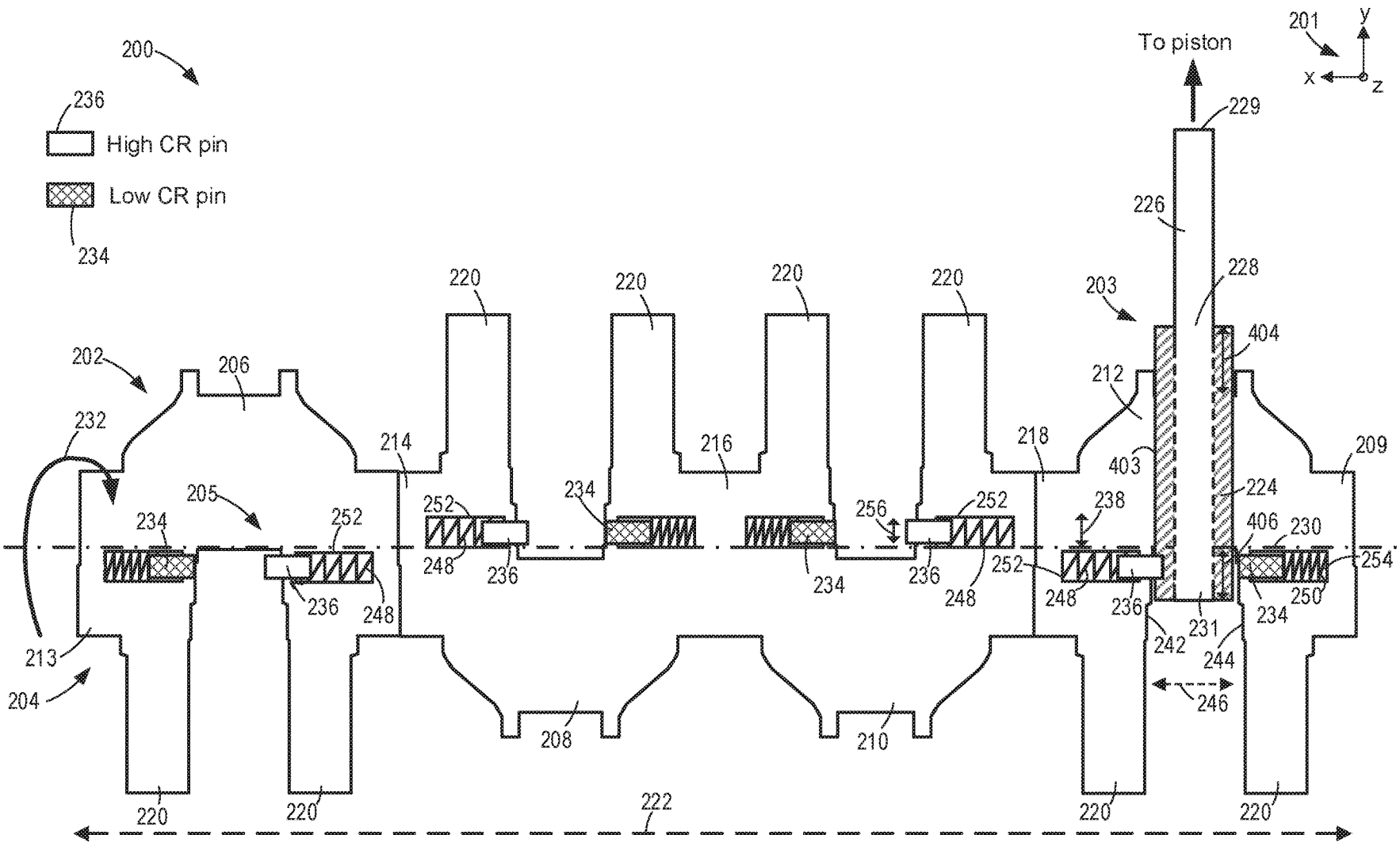
FIG. 2 shows a schematic diagram of a crankshaft that may be included in the engine system of FIG. 1 coupled to the VCR mechanism, in a first configuration.
Figure 3:
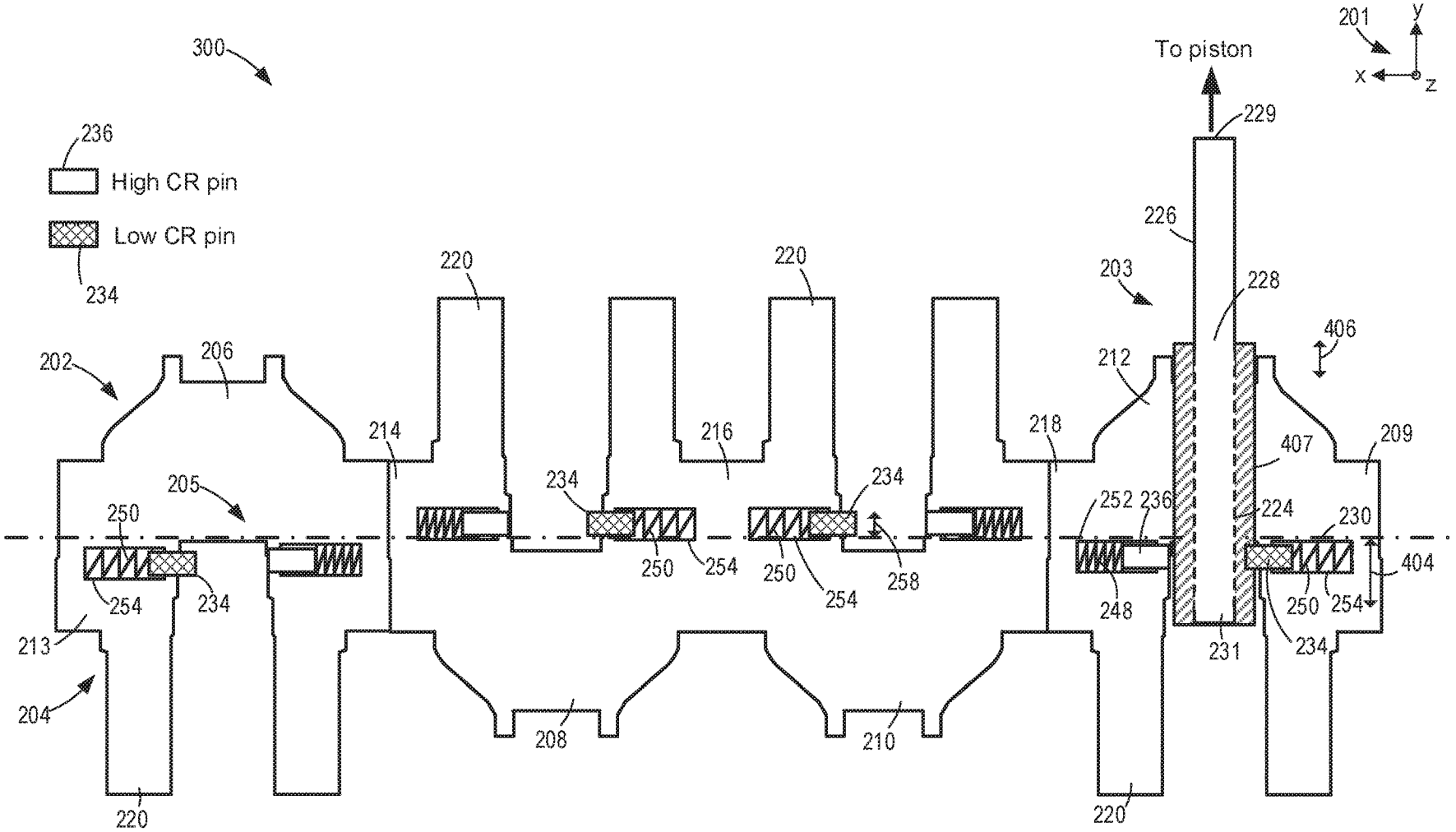
FIG. 3 shows a schematic diagram of the crankshaft of FIG. 2 with the VCR mechanism in a second configuration.
Figure 5:
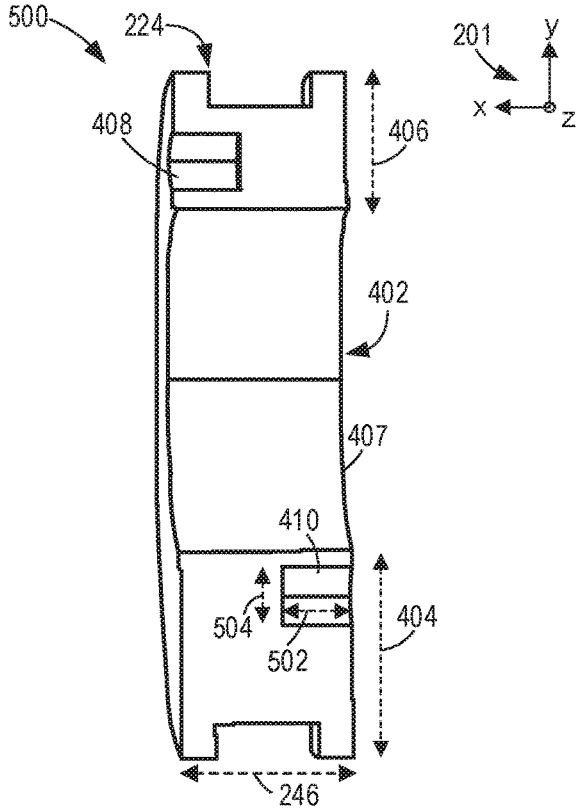
FIG. 5 shows the cross-section of the eccentric in a second position.
Figure 6:
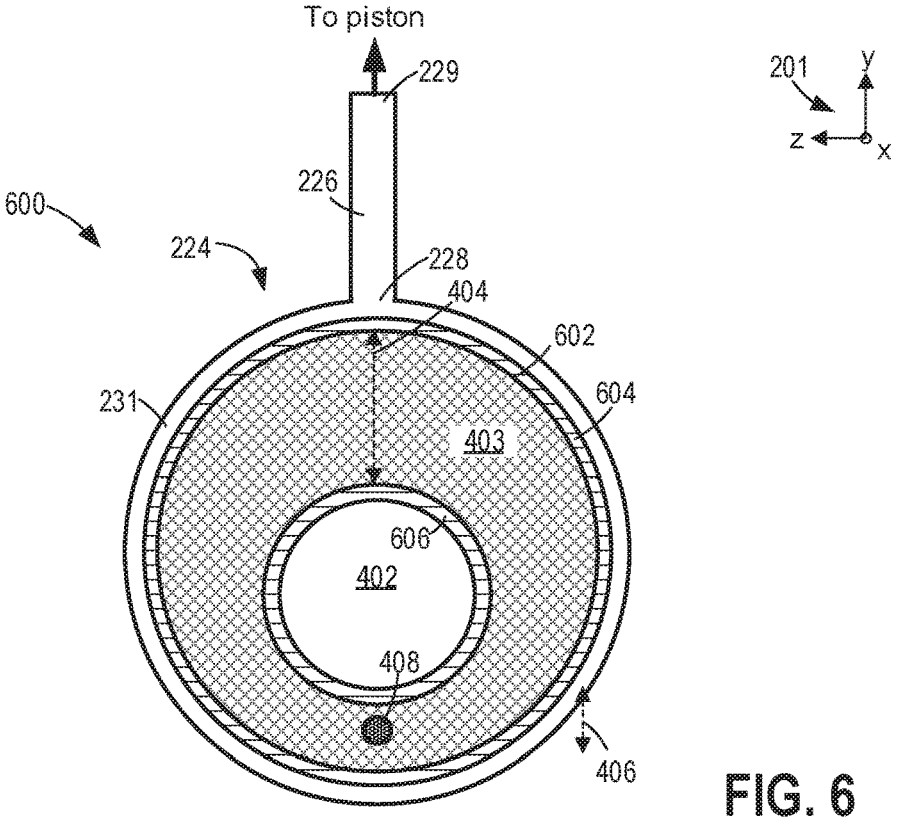
FIG. 6 shows a profile view of the eccentric.
Figure 8:
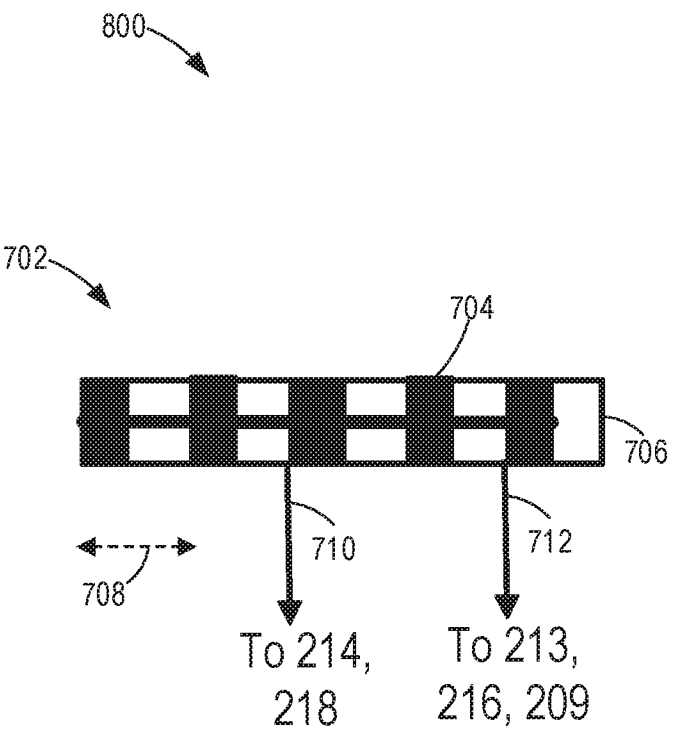
FIG. 8 shows a schematic diagram of the valve of FIG. 7 in a second position.
Figure 7:
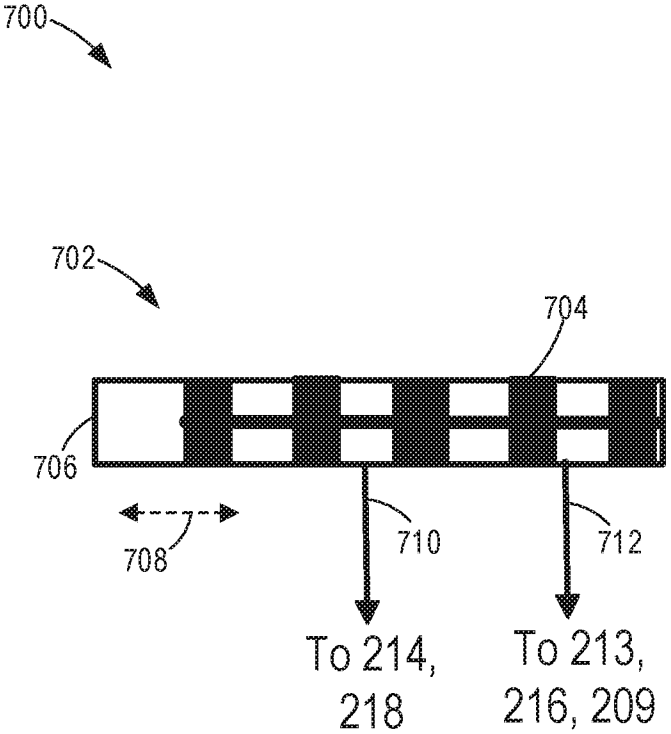
FIG. 7 shows a schematic diagram of a valve that adjusts hydraulic pressure in the VCR mechanism in a first position.

The following description relates to systems and methods for a variable compression ratio (VCR) engine. The VCR engine may increase vehicle fuel economy by allowing an engine compression ratio to be varied as engine operating conditions change. The compression ratio may be adjusted between a relatively high ratio and a relatively low ratio to provide an engine power output that matches a torque demand while decreasing a likelihood of engine knock. During low engine loads and speeds, a fuel economy of the engine may be enhanced by adjusting the compression ratio. An engine system that may include a VCR mechanism to vary the compression ratio in shown in FIG. 1. The compression ratio may be adjusted based on a combination of hydraulic pressure and mechanical locking devices. The engine system may have a non-linear crankshaft including a plurality of crankpins, as shown in FIGS. 2 and 3. Each of the crankpins may be coupled to an eccentric, the eccentric varying a piston height depending on an orientation of the eccentric with respect to the crankpin. The eccentric may be adjusted to a first position, as shown in FIG. 2 and depicted in greater detail in FIG. 4. The eccentric may also be adjusted to a second position, as shown in FIG. 3 and depicted in greater detail in FIG. 5. A profile view of the eccentric is illustrated in FIG. 6, showing a biasing of a placement of an aperture extending through the eccentric. The eccentric may be locked into the first position or second position by mechanical locking pins that slide in and out of reciprocating slots, or detents, in the eccentric. Movement of the locking pins may be actuated by a valve that includes a solenoid and adjust fluidic communication of the VCR mechanism with oil reservoirs to leverage a hydraulic pressure provided by the oil reservoirs. The valve is shown in a first position in FIG. 7 and a second position in FIG. 8, corresponding to a high compression ratio and a low compression ratio, respectively. Management of the engine compression ratio via the VCR mechanism during engine operation is described in FIG. 9 in an example of a method for varying the compression ratio. Example operations of elements of the VCR mechanism in response to engine load and charging is shown in a timeline diagram of FIG. 10.

FIGS. 1-8 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Figure 1:
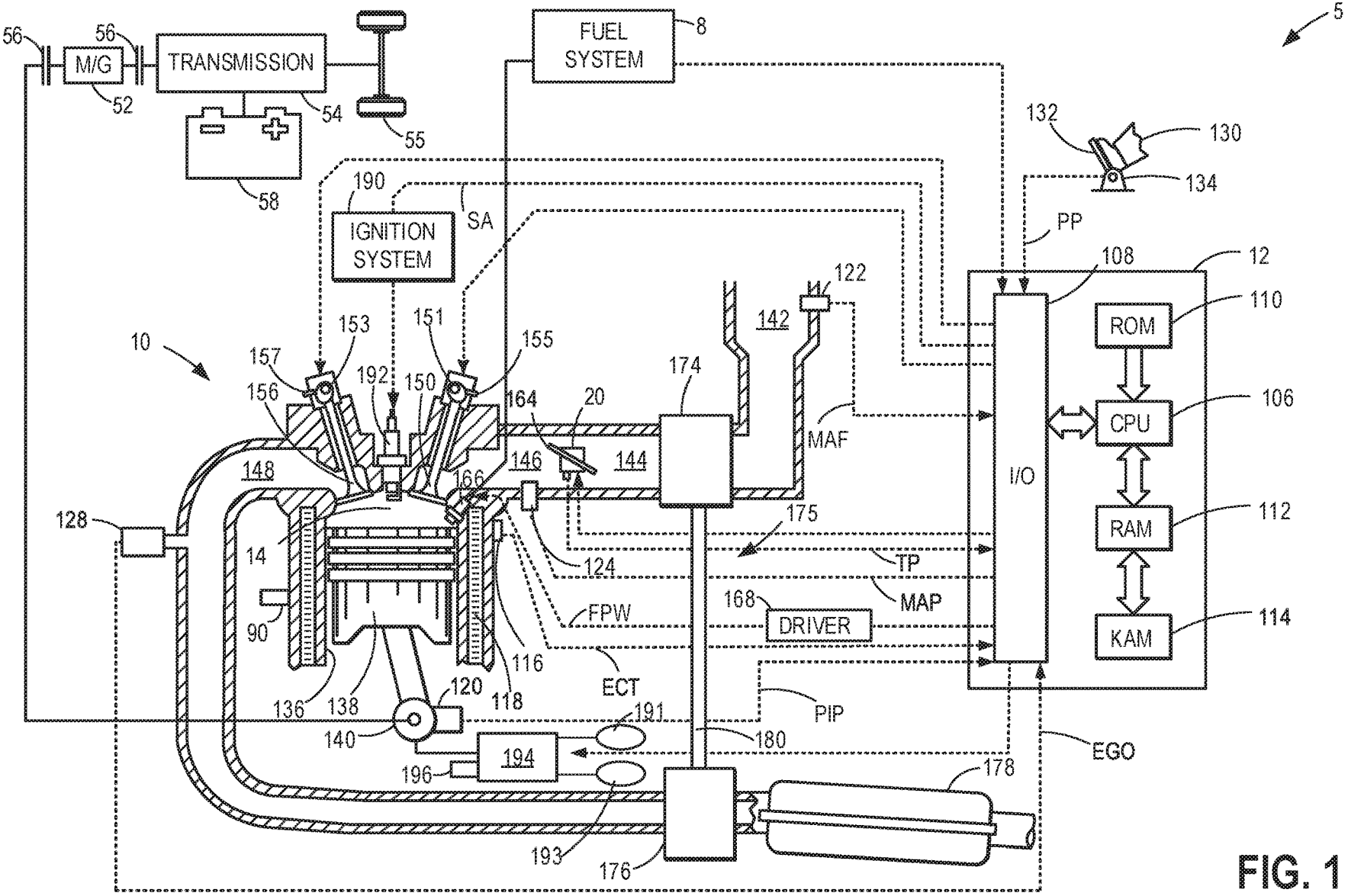
FIG. 1 shows an example of an engine system in which a compression ratio may be varied by a variable compression ratio (VCR) mechanism.

FIG. 1 depicts an example embodiment of a combustion chamber (herein, also referred to as "cylinder") 14 of an internal combustion engine 10, which may be included in a passenger vehicle 5. Engine 10 may receive control parameters from a control system, including a controller 12, and input from a vehicle operator 130 via an input device 132. In this example, input device 132 includes an accelerator pedal and a pedal position sensor 134 for generating a proportional pedal position signal PP. Cylinder 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 of the passenger vehicle via a transmission system 54. Further, a starter motor may be coupled to crankshaft 140 via a flywheel to enable a starting operation of engine 10.

Engine 10 may be configured as a VCR engine wherein the compression ratio (CR) of each cylinder—a ratio of a cylinder volume when the piston is at bottom-dead-center (BDC) to a cylinder volume when the piston is at top-dead-center (TDC)—can be mechanically altered. The CR of the engine may be varied via a VCR mechanism 194. In some examples, the CR may be varied between a first, lower CR (wherein the ratio of the cylinder volume when the piston is at BDC to the cylinder volume when the piston is at TDC is smaller) and a second, higher CR (wherein the ratio is higher). In still other examples, there may be predefined number of stepped compression ratios between the first, lower CR and the second, higher CR. Further still, the CR may be continuously variable between the first, lower CR and the second, higher CR (to any CR in between).

In the depicted example, VCR mechanism 194 is coupled to piston 138 such that the VCR mechanism may change the piston TDC position. For example, piston 138 may be coupled to crankshaft 140 via VCR mechanism 194, which may be a piston position changing mechanism that moves the piston closer to or further from the cylinder head, thus changing the position of the piston and thereby the size of combustion chamber 14. A position sensor 196 may be coupled to the VCR mechanism 194 and may be configured to provide feedback to controller 12 regarding the position of VCR mechanism 194 (and thereby the CR of the cylinder).

In one example, changing the position of the piston within the combustion chamber also changes the relative displacement of the piston within the cylinder. The piston position changing VCR mechanism may be coupled to a conventional cranktrain or an unconventional cranktrain. Non-limiting examples of an unconventional cranktrain to which the VCR mechanism may be coupled includes variable distance head crankshafts and variable kinematic length crankshafts. In one example, crankshaft 140 may be configured as an eccentric shaft. In another example, an eccentric may be coupled to, or in the area of, a piston pin, with the eccentric changing the position of the piston within the combustion chamber. Movement of the eccentric may be controlled by oil passages in the piston rod.

In one example, the VCR mechanism 194 may include a first component that varies the position of the piston and a second component that maintains the position of the piston by locking VCR mechanism 194 in place. The second component may be actuated based on hydraulic pressure provided by oil reservoirs in engine 10. As such, the VCR mechanism is shown coupled to a high pressure oil reservoir 191 and a low pressure oil reservoir 193. Further details of the VCR mechanism 194 will be discussed below with reference to FIGS. 2-8.

It will be appreciated that as used herein, the VCR engine may be configured to adjust the CR of the engine via mechanical adjustments that vary a piston position or a cylinder head volume. As such, VCR mechanisms do not include CR adjustments achieved via adjustments to intake/exhaust valve timing or cam timing.

By adjusting the position of the piston within the cylinder, an effective (static) compression ratio of the engine (e.g., a difference between cylinder volumes at TDC relative to BDC) can be varied. In one example, reducing the compression ratio includes reducing a displacement of the piston within the combustion chamber by increasing the distance between the top of the piston from the cylinder head. For example, the engine may be operated at a first, lower compression ratio by adjustment of the VCR mechanism 194 to a first position where the piston has a smaller effective displacement within the combustion chamber. As another example, the engine may be operated at a second, higher compression ratio by adjusting the VCR mechanism 194 to a second position where the piston has a larger effective displacement within the combustion chamber. Changes in the engine compression ratio may be advantageously used to improve fuel economy. For example, the higher compression ratio may be used to improve fuel economy at light to moderate engine loads until spark retard from early knock onset erodes the fuel economy benefit. The engine can then be switched to the lower compression ratio, thereby trading off thermal efficiency for combustion phasing efficiency. In comparison, the lower compression ratio may be selected to improve performance at mid-high engine loads. Continuous VCR systems may continuously optimize the combustion phasing and the thermal efficiency to provide the best compression ratio between the higher compression ratio and lower compression ratio limits at the given operating conditions.

Returning to FIG. 1, cylinder 14 may receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger 175, including a compressor 174 arranged between intake passages 142 and 144 and an exhaust turbine 176 arranged along an exhaust passage 148. As shown, compressor 174 may be at least partially powered by exhaust turbine 176 via a shaft 180. However, in other examples, such as where engine 10 is configured with a supercharger, exhaust turbine 176 may be optionally omitted, and compressor 174 may instead be powered by mechanical input from a motor of the engine.

A throttle 20, including a throttle plate 164, may be provided between intake air passage 144 and intake air passage 146 for varying the flow rate and/or pressure of intake air provided to the engine cylinders. For example, throttle 20 may be disposed downstream of compressor 174, as shown in FIG. 1, or may alternatively be provided upstream of compressor 174.

Exhaust passage 148 may receive exhaust gases from other cylinders of engine 10 in addition to cylinder 14. An exhaust gas sensor 128 is shown coupled to exhaust passage 148 upstream of an emission control device 178. Exhaust gas sensor 128 may be any suitable sensor for providing an indication of exhaust gas air-fuel ratio (AFR), such as a linear oxygen sensor or UEGO (universal or wide-range exhaust gas oxygen), a two-state oxygen sensor or EGO (as depicted), a HEGO (heated EGO), a NOx, a HC, or a CO sensor, for example. Emission control device 178 may be a three way catalyst (TWC), NOx trap, various other emission control devices, or combinations thereof.

Exhaust temperature may be estimated by one or more temperature sensors (not shown) located in exhaust passage 148. Alternatively, exhaust temperature may be inferred based on engine operating conditions such as engine speed, engine load, AFR, spark timing, etc. Further, exhaust temperature may be determined from one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including one intake poppet valve 150 and one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via a cam actuation system 151. Similarly, exhaust valve 156 may be controlled by controller 12 via a cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 150 and exhaust valve 156 may be determined by valve position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation, including CPS and/or VCT systems. In still other embodiments, the intake and exhaust valves may be controlled by a common valve actuator or actuation system or a variable valve timing actuator or actuation system.

Cylinder 14 may have an associated compression ratio, which, as described above, is the ratio of volumes when piston 138 is at BDC to TDC. Conventionally, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock. The compression ratio may also be varied based on driver demand via adjustments to the VCR mechanism 194, varying the effective position of piston 138 within combustion chamber 14. The compression ratio may be inferred based on feedback from sensor 196 regarding the position of the VCR mechanism 194.

In some embodiments, each cylinder of engine 10 may include a spark plug 192 for initiating combustion. An ignition system 190 may provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel, as may be the case with some diesel engines.

In some embodiments, each cylinder of engine 10 may be configured with one or more fuel injectors for providing fuel thereto. As a non-limiting example, cylinder 14 is shown including one fuel injector 166. Fuel injector 166 is shown coupled directly to cylinder 14 for injecting fuel directly therein in proportion to the pulse width of signal FPW received from controller 12 via electronic driver 168. In this manner, fuel injector 166 provides what is known as direct injection ("DI") of fuel into combustion cylinder 14. While FIG. 1 shows injector 166 as a side injector, injector 166 may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a high pressure fuel system 8, which may include one or more fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the one or more fuel tanks may have a pressure transducer providing a signal to controller 12. It will be appreciated that, in an alternate embodiment, injector 166 may be a port injector providing fuel into the intake port upstream of cylinder 14.

It will also be appreciated that while the depicted embodiment illustrates the engine being operated by injecting fuel via a single direct injector, in alternate embodiments, the engine may be operated by using two or more injectors (for example, a direct injector and a port injector per cylinder, or two direct injectors/two port injectors per cylinder, etc.) and varying a relative amount of injection into the cylinder from each injector.

Fuel may be delivered by the injector to the cylinder during a single cycle of the cylinder. Further, the distribution and/or relative amount of fuel delivered from the injector may vary with operating conditions. Furthermore, for a single combustion event, multiple injections fuel may be performed per cycle. The multiple injections may be performed during the compression stroke, intake stroke, or any appropriate combination thereof in what is known as split injection. Also, fuel may be injected during the cycle to adjust the air-fuel ratio (AFR) of the combustion. For example, fuel may be injected to provide a stoichiometric AFR. An AFR sensor may be included to provide an estimate of the in-cylinder AFR. In one example, the AFR sensor may be an exhaust gas sensor, such as EGO sensor 128. By measuring an amount of oxygen in the exhaust gas, which is higher for lean mixtures and lower for rich mixtures, the sensor may determine the AFR. As such, the AFR may be provided as a lambda (λ) value, which is a ratio of the determined AFR to a stoichiometric AFR (e.g., the AFR for a complete combustion reaction to occur) for a given mixture. Thus, a λ, value of 1.0 indicates a stoichiometric mixture, while a λ, value less than 1.0 indicates richer than stoichiometry mixtures and a λ, value greater than 1.0 indicates leaner than stoichiometry mixtures.

As described above, FIG. 1 shows only one cylinder of a multi-cylinder engine. As such each cylinder may similarly include its own set of intake/exhaust valves, fuel injector(s), spark plug(s), etc.

Fuel tanks in fuel system 8 may hold fuel with different fuel qualities, such as different fuel compositions. These differences may include different alcohol content, different octane, different heats of vaporization, different fuel blends, and/or combinations thereof, etc.

Controller 12 is shown in FIG. 1 as a microcomputer, including a microprocessor unit 106, input/output ports 108, an electronic storage medium for executable programs and calibration values shown as read-only memory chip 110 in this particular example, a random access memory 112, a keep alive memory 114, and a data bus. Controller 12 may receive various signals from sensors coupled to engine 10, including, in addition to those signals previously discussed, a measurement of inducted mass air flow (MAF) from a mass air flow sensor 122, a knock sensor 90 coupled to each cylinder 14 for identifying abnormal cylinder combustion events, engine coolant temperature (ECT) from a temperature sensor 116 coupled to a cooling sleeve 118, a profile ignition pickup signal (PIP) from a Hall effect sensor 120 (or other type) coupled to crankshaft 140, throttle position (TP) from a throttle position sensor, an absolute manifold pressure signal (MAP) from a MAP sensor 124, cylinder AFR from EGO sensor 128, abnormal combustion from knock sensor 90 and a crankshaft acceleration sensor, and VCR mechanism position from position sensor 196. Engine speed signal, RPM, may be generated by controller 12 from signal PIP. The signal MAP from MAP sensor 124 may be used to provide an indication of vacuum or pressure in the intake manifold. Controller 12 receives signals from the various sensors of FIG. 1 and employs the various actuators of FIG. 1 to adjust engine operation based on the received signals and instructions stored on a memory of the controller. For example, based on the engine speed and load, the controller may adjust the compression ratio of the engine by sending a signal to the VCR mechanism 194 to mechanically move the piston closer to or further from the cylinder head, thereby changing a volume of the combustion chamber.

Non-transitory storage medium read-only memory 110 can be programmed with computer readable data representing instructions executable by microprocessor unit 106 for performing the methods described below as well as other variants that are anticipated but not specifically listed.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example, during a braking operation.

Variation of an engine compression ratio may be achieved by coupling a crankshaft of an engine to a VCR mechanism. The VCR mechanism may include a first component, such as an eccentric, coupled to the crankshaft and configured to adjust a displacement of a piston within a combustion chamber, thereby varying the compression ratio. A second component of the VCR mechanism may be used to mechanically lock a position of the piston, thus maintaining the compression ratio. Movement of the second component between an engaged and a disengaged orientation may be controlled by an actuator relying on hydraulic pressure to facilitate adjustment of the second component. In this way, the VCR mechanism does not depend on a mechanical actuating system, such as gears or a motor that contributes to NVH issues and adds complexity and weight to the engine. Furthermore, the actuation of the VCR mechanism does not adversely affect energy consumption of the engine, thereby increasing a fuel economy of the engine by varying the compression ration according to engine operating conditions. In addition, by coupling the eccentric to the crankshaft rather than to the piston, a mass balance of mobile engine components is maintained.

An example of a VCR mechanism 202 for an inline four cylinder (I4) engine is shown in a first configuration 200 in FIG. 2. It will be appreciated that while an arrangement for an I4 engine is shown in FIG. 2 (and in FIG. 3), other examples of the VCR mechanism may include adaptations of the mechanism to other types of engines, such as V6, V8, I3, etc. A set of reference axis 201 is provided, indicating a y-axis, an x-axis, and a z-axis. The VCR mechanism 202 is implemented in a crankshaft 204 that includes a first rod bearing journal or crankpin 206, a second crankpin 208, a third crankpin 210, and a fourth crankpin 212. The crankpins are aligned along the crankshaft 204 and sandwiched between main bearing journals. The crankshaft 204 includes a first main bearing journal 213, a second main bearing journal 214, a third main bearing journal 216, a fourth main bearing journal 218, and a fifth main bearing journal 209. Each main bearing journal is spaced apart from adjacent main bearing journals by one of the crankpins. More specifically, the second main bearing journal 214 is positioned between the first crankpin 206 and the second crankpin 208, the third main bearing journal 216 is positioned between the second crankpin 208 and the third crankpin 210, and the fourth main bearing journal 218 is positioned between the third crankpin 210 and the fourth crankpin 212. The crankshaft 204 also includes a plurality of counterweights 220 disposed along a length 222 of the crankshaft 204, the plurality of counter weights 220 evenly spaced apart by an alternating arrangement of crankpins and main journal bearings.

The VCR mechanism 202 may have a first portion 203 comprising a plurality of eccentrics encircling the crankshaft 204. One eccentric 224 is shown in FIGS. 2 and 3 for simplicity, the eccentric 224 circumferentially surrounding the fourth crankpin 212, but the VCR mechanism 202 may have an eccentric positioned around each crankpin of the crankshaft 204. The eccentric 224 is coupled to a conrod 226 at a first end 228 of the conrod 226. A second end 229 of the conrod 226 may be coupled to a bottom of a piston, such as the piston 138 of FIG. 1. In this way, the first end 228 of the conrod 226 and the eccentric 224 coupled thereto are distal to the piston relative to the second end 229 of the conrod 226.

The first end 228 of the conrod 226 may have a ring 231, as shown in FIG. 6, that encircles the eccentric 224, spaced away from an outer surface of the eccentric 224 by a first bearing 604. In other words, the first bearing 604 is arranged between the ring 231 and the eccentric 224 and an outer surface of the first bearing 604 is in direct contact with an inner surface of the ring 231 and an inner surface of the first bearing 604 is in direct contact with the outer surface of the eccentric 224. The first bearing 604 may be fixed to, e.g., attached to, the ring 231 of the conrod 226 and may allow the ring 231 of the conrod 226 to rotate freely around the eccentric 224 as the first end 228 of the conrod 226 oscillates during engine operations.

A second bearing 606 may be arranged between the eccentric 224 and the fourth crankpin 212 (shown in FIGS. 2 and 3). As such, the inner surface of the eccentric 224 is in direct contact with an outer surface of the second bearing 606 and an inner surface of the second bearing 606 is in direct contact with an outer surface of the fourth crankpin 212. The second bearing 604 may be fixed to, e.g., attached to, the eccentric 224 and may allow a high oil film shear force to be generated between the eccentric 224 and the fourth crankpin 212 to constrain rotational movement to a single direction. For example, the eccentric 224 may rotate relative to the crankpin 212 in a clockwise direction and not in a counterclockwise direction or vice versa.

Returning to FIG. 2, when the crankshaft 204 rotates, the eccentric 224 may either rotate in unison with the fourth crankpin 212 within the first end 228 of the conrod 226, e.g. the eccentric 224 is fixed to the fourth crankpin 212 and rotates relative to the ring 231, or the unidirectional oil shear force between the outer surface of the fourth crankpin 212 and an inner surface of the eccentric 224 may cause the eccentric 224 rotate around the fourth crankpin 212.

For example, as the crankshaft 204 rotates, as indicated by arrow 232, the conrod 226 may shift up and down along the y-axis and simultaneously vary in angle by a swinging motion at the first end 228 of the conrod 226 within the y-z plane. More specifically, the second end 229 of the conrod 226 may move up and down along the y-axis but remain invariant with respect to the z-axis due to coupling of the second end 229 to the piston that slides up and down within a cylinder. The first end 228 of the conrod 226, however, may swing through a range of angles along the z-axis as the crankshaft 204 rotates due to the coupling of the first end 228 to the fourth crankpin 212 via the eccentric 224, e.g., the ring 231 at the first end 228 that circumferentially surrounds the eccentric 224 that encircles the fourth crankpin 212. Thus, the first end 228 of the conrod 226 swings back and forth along the y-z plane while shifting up and down along the y-axis.

The eccentric 224 may remain in a static position relative to the fourth crankpin 212 and rotate with the crankshaft 204 when mechanically locked to the fourth crankpin 212. The fourth crankpin 212 may move through a circle in the y-z plane due to a distance 238 that the fourth crankpin 212 is offset from an axis of rotation 230 of the crankshaft 204. Alternatively, the eccentric 224 may be compelled to rotate relative to the fourth crankpin 212 when the eccentric 224 is unlocked from the fourth crankpin 212 due to oil shear forces generated between the second bearing 606, as shown in FIG. 6, of the eccentric 224 and the fourth crankpin 212, inducing spinning of the eccentric 224 around the fourth crankpin 212 in one direction. As the eccentric 224 is in the unlocked configuration, the eccentric 224 rotates with respect to the fourth crankpin 212. In this way, without participation of any additional mechanisms or devices, the rotation of the eccentric 224 around the fourth crankpin 212 may be induced by oil shear forces between the fourth crankpin 212 and the second bearing 606, as shown in FIG. 6 as the crankshaft 204 spins about the axis of rotation 230. To halt rotation of the eccentric 224 around the fourth crankpin 212, the eccentric 224 may be fixedly coupled to the fourth crankpin 212 by a second portion 205 of the VCR mechanism 202.

The second portion 205 of the VCR mechanism 202 includes a low compression ratio (LCR) pin 234 (e.g., with crosshatching) and a high compression ratio (HCR) pin 236 (e.g., no crosshatching) for each eccentric 224 of the crankshaft 204. For example, at the fourth crankpin 212, the LCR pin 234 on the right-hand side of the eccentric 224 is positioned in the fifth main bearing journal 209 to the right of the eccentric 224, the LCR pin 234 aligned with the x-axis. The HCR pin 236 on the left-hand side of the eccentric 224 is positioned in the fourth main bearing journal 218 to the left of the eccentric 224. The LCR pin 234 and the HCR pin 236 are disposed in the bearing journals of the crankshaft 202 along to the axis of rotation 230 of the crankshaft 202 to reduce a centrifugal force during rotation of the crankshaft 202 that may otherwise inhibit movement of the LCR pin 234 and the HCR pin 236 along the x-axis.

The HCR pin 236 for the fourth crankpin 212 is shown protruding from a first inner surface 242 of the fourth main bearing journal 218 along the x-axis, the first inner surface 242 having a plane perpendicular to the axis of rotation 230. The protrusion of the HCR pin 236 enables the HCR pin 236 to engage with the eccentric 224, as shown at the fourth crankpin 212, by sliding into, for example, a slot or detent in the eccentric 224 configured to receive the HCR pin 236. In comparison, the LCR pin 234 does not protrude from a second inner surface 244 of the fifth main bearing journal 209, the second inner surface 244 co-planar with the first inner surface 242 and spaced away from the first inner surface 242 by a width 246 of the eccentric 224.

The LCR pin 234 and the HCR pin 236 may be similar in dimensions and geometry to one another or different. In one example, both pins may have circular cross-sections, taken along the y-z plane, with similar diameters. In other examples, the pins may have different lengths, diameters or different cross-sectional shapes. For example, the LCR pin 234 may have a square cross-section while the HCR pin 236 has a circular cross-section or the LCR pin 234 may be longer, along the x-axis, than the HCR pin 236. A variety of combinations of shapes and relative sizes of the pins have been contemplated.

The HCR pin 236 may be coupled to a first spring 248 and the LCR pin 234 may be coupled to a second spring 250. The first spring 248 is enclosed within a first chamber 252 that also houses the HCR pin 236. The first chamber 252 is disposed within the third main bearing journal 218, extending along the x-axis, and may be sealingly engaged at one end with the HCR pin 236 so that oil flowing into the first chamber 252 from an external oil reservoir may be sealed within the first chamber 252, e.g., the HCR pin 236 acts as a plug to the first chamber 252. In addition, the HCR pin 236 may slide in and out of the first chamber 252 along the x-axis.

The second spring 250 may be enclosed within a second chamber 254 that also houses the LCR pin 234. The second chamber 254 is disposed within the fifth main bearing journal 209 and may extend along the x-axis. The second chamber 254 may be also be plugged by the LCR pin 234, similar to the arrangement of the HCR pin 236 in the first chamber 252, retaining oil within the second chamber 254 while allowing the LCR pin 234 to slide in and out of the second chamber 254 along the x-axis. A sliding of the HCR pin 236 and LCR pin 234 along the x-axis may allow adjustment of the engine compression ratio, according to which pin engages with the eccentric 224.

Figure 4:
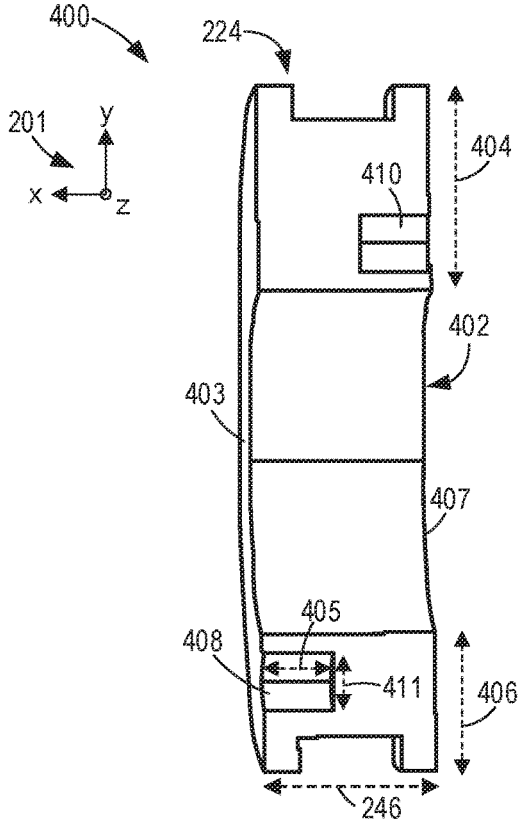
FIG. 4 shows a cross-section of an eccentric included in the VCR mechanism, in a first position.

For example, a high CR configuration is shown in FIG. 2, corresponding to an orientation of the eccentric 224 shown in FIGS. 4 and 6. A first cross-section 400 of the eccentric 224 is depicted in FIG. 4 and a side view 600 of the eccentric 224 is illustrated in FIG. 6. The HCR pin 236 is protruding from the first inner surface 242 of the third main bearing journal 218 and inserted into a first detent 408, as shown in FIG. 4, of the eccentric 224, thereby maintaining a position of the eccentric 224 relative to the fourth crankpin 212, e.g., fixing a position of the eccentric 224 to the fourth crankpin 212.

The first detent 408 may extend along the x-axis from a first side surface 403 of the eccentric along a portion of the width 246 of the eccentric 224. A distance 405 that the first detent 408 extends in the width 246 may be 30-50% of the width 246 of the eccentric 224. The first detent 408 may have a height 411, as shown in FIG. 4, that is similar to or slightly larger than a first diameter 256 of the HCR pin 236, as shown in FIG. 2 to allow insertion of the HCR pin 236 into the first detent 408. A cross-section of the first detent 408, taken along the y-z plane, may be circular, in one example. In other examples, the cross-section of the first detent 408 may be some other geometry to accommodate a shape or size of HCR pin 236, such as square, oval, hexagonal, etc.

The eccentric 224 has an aperture 402 that is biased so that the aperture 402 is not positioned at a geometric center of the eccentric 224. As a result of the biased positioning of the aperture 402, the eccentric 224 is thicker along a first region 404 than a second region 406, the thickness measured along the y-axis. The thickness of the eccentric increases continuously from the second region 406 to the first region 404, along a circumference 602 of the eccentric 224 shown in FIG. 6.

When the eccentric 224 is positioned as shown in FIGS. 2, 4, and 6, the first, thicker region 404 is oriented above, relative to the y-axis, the second, thinner region 406. Insertion of the fourth crankpin 212 through the aperture 402 of the eccentric 224, as shown in FIG. 2, results in the eccentric 224 extending a greater distance above the fourth crankpin 212, the distance above the fourth crankpin 212 equivalent to the thickness of the first region 404, than a distance that the eccentric 224 extends below the fourth crankpin 212, the distance below the fourth crankpin 212 equivalent to the thickness of the second region 406 of the eccentric 224. As the crankshaft 204 rotates, the eccentric 224 rotates within the first end 228 of the conrod 226.

When the crankshaft is rotated by 180 degrees relative to the position shown in FIG. 2, the eccentric 224 is oriented so that the fourth crankpin 212 is below the axis of rotation 230, with respect to the y-axis, and the first, thicker region 404 of the eccentric 224 is also below the axis of rotation 230 and at a bottom of the eccentric 224 with the second, thinner region 406 at a top of the eccentric 224. In this orientation, the piston coupled to the second end 229 of the conrod 226 is in a BDC position. Further rotation of the crankshaft by another 180 degrees to the configuration shown in FIG. 2 may correspond to a TDC position of the piston. The orientation of the eccentric 224 with the first, thicker region 404 above the axis of rotation 230 and at the top of the eccentric 224 pushes the TDC position of the piston higher along the y-axis than any other orientation of the eccentric 224 relative to the fourth crankpin 212, e.g., when the eccentric 224 is rotated around the fourth crankpin 212 so that the first region 404 is not at the top of the eccentric 224 when the fourth crankpin 212 is above the axis of rotation 230 as shown in FIG. 2. Thus, engagement of the HCR pin 236 with the first detent 408 of the eccentric 224 corresponds to an increased CR of the engine compared to any other orientation of the eccentric 224 around the fourth crankpin 212.

The engine may be adjusted to a second, lower CR configuration 300 by disengaging the HCR pin 236 from the eccentric 224 and engaging the LCR pin 234 with the eccentric 224, as shown in FIG. 3. An orientation of the eccentric 224 shown in FIG. 3 corresponds to an orientation of the eccentric 224 depicted in a second cross-section 500 in FIG. 5. The LCR pin 234 may be inserted into a second detent 410 in the eccentric 224, as shown in FIGS. 4 and 5, the second detent 410 extending from a second side surface 407 of the eccentric 224 along a portion of the width 246 of the eccentric 224, the second side surface 407 opposite of the first side surface 403 of the eccentric 224. In addition to a positioning of the second detent 410 in an opposite side surface of the eccentric 224 from the first detent 408, the second detent 410 may also be oriented 180 degrees relative to the first detent 408 around the circumference 602 of the eccentric 224. For example, when the eccentric 224 is rotated so that the first detent 408 is at the top of the eccentric 224, the second detent 410 is at the bottom of the eccentric 224, and rotation of the eccentric 224 so that the second detent 410 is at the top of the eccentric 224 positions the first detent 408 at the bottom of the eccentric 224.

A distance 502, shown in FIG. 5, that the second detent 410 extends into the width 246 of the eccentric 224 from the second side surface 407 may be 30-50% of the width 246 of the eccentric 224, similar to the first detent 408. A height 504, defined along the y-axis, of the second detent 410 may be similar to or slightly larger than a second diameter 258 of the LCR pin 234, as shown in FIG. 3, to allow insertion of the LCR pin 234 into the second detent 410. A cross-section of the second detent 410, taken along the y-z plane, may be circular, in one example. In other examples, the cross-section of the second detent 410 may be some other geometry to accommodate a shape or size of the LCR pin 234, such as square, oval, hexagonal, etc.

In the second configuration 300 shown in FIG. 3, the eccentric 224 is oriented oppositely from that of the first configuration 200 of FIG. 2. When the fourth crankpin 212 is positioned above the axis of rotation 230, with respect to the y-axis, corresponding to the TDC position of the piston, engagement of the LCR pin 234 with the second detent 410 of the eccentric 224 locks the eccentric to the fourth crankpin 212. Relative to the first configuration 200 of FIG. 2, the positioning of the second, thinner region 406 at the top of the eccentric 224, as shown in FIG. 3, results in the piston height at TDC being lower than the piston height at TDC in the first configuration 200. As such, the second configuration 300 maintains the eccentric 224 in an orientation that provides a lower engine CR than the first configuration 200.

Conversion of the engine between the higher CR configuration and the lower CR configuration may be enabled based on changes in hydraulic pressure in the first chamber 252 and the second chamber 254, housing the HCR pin 236 and the LCR pin 234, respectively. In one example, the second portion 205 of the VCR mechanism 202 may be controlled by a directional control valve (DCV), such as a solenoid-operated DCV. An example of a DCV 702 is shown in a higher CR configuration 700 in FIG. 7 and a lower CR configuration 800 in FIG. 8. The DCV 702 may be fluidly coupled to a high pressure oil reservoir, such as downstream of an oil pump delivering oil from an engine oil gallery. Additionally, the DCV 702 may be fluidly coupled to a first oil channel 710 flowing oil to the second main bearing journal 214 and fourth main bearing journal 218 shown in FIGS. 2 and 3. In some examples, the first oil channel 710 may split into two passages at a point between the DCV 702 and the crankshaft 204, to direct flow to each of the second and fourth main bearing journals 214, 218. The DCV 702 may be similarly fluidly coupled to a second oil channel 712 flowing oil to the first main bearing journal 213, the third main bearing journal 216, and the fifth main bearing journal 209. In some examples, the second oil channel 712 may split into three branches at a point between the DCV 702 and the crankshaft 204 to channel oil flow to each of the first, third, and fifth main bearing journals 213, 216, and 209. Furthermore, the DCV 702 may be fluidly coupled to a low pressure (e.g., ambient pressure) oil reservoir, such as an engine oil sump.

The DCV 702 includes a spool 704 arranged inside a cylinder 706, the spool 704 slidable within the cylinder 706 as indicated by arrow 708. Movement of the spool 704 may be actuated by an electromagnet. For example, an electromagnet positioned to the right of the DCV 702 may compel the spool 704 to slide to the right into the high CR configuration 700 when activated. However, other methods for facilitating movement of the spool 704 have been contemplated, such as pneumatic, hydraulic, mechanical, or manual methods of actuation. In the high CR configuration 700, the spool 704 may be positioned so that the first oil channel 710 is fluidly coupled to the high pressure oil reservoir, such as the high pressure oil reservoir 191 of FIG. 1, and the second oil channel 712 is coupled to the low pressure oil reservoir, such as the low pressure oil reservoir 193 of FIG. 1. The high pressure oil flows to the second main bearing journal 214 and the fourth main bearing journal 218 and into each first chamber 252, as shown in FIG. 2, disposed in each of the second main bearing journal 214 and the fourth main bearing journal 218 (e.g., two first chambers per main bearing journal). The flow of oil into each first chamber 252 forces the HCR pin 236 to slide out of the first chamber 252, to protrude from an inner surface of the main bearing journal, such as the first inner surface 242 of the fourth main bearing journal 218, overcoming an opposing spring force exerted on the HCR pin 236 by the first spring 248. When protruding from the inner surface of the main bearing journal out of the first chamber 252, the HCR pin 236 may not be engaged with eccentric 224 if the HCR pin 236 is not aligned with the first detent 408 of the eccentric 224 or may be engaged with the eccentric 224 if the HCR pin 236 is aligned with the first detent 408.

The eccentric 224, as shown in FIGS. 2 and 3, when not engaged by either the HCR pin 236 or the LCR pin 234 may be rotate relative to the fourth crankpin 212 due to oil shear forces between the second bearing 606 (as shown in FIG. 6) of the eccentric 224 and the fourth crankpin 212. As the crankshaft 204 rotates during engine operation each eccentric 224 may rotate relative to each crankpin. For example, the fourth crankpin 212 may rotate within the first end 228 of the conrod 226 with the DCV 702 in the high CR configuration 700 of FIG. 7. An end of the HCR pin 236 may be in contact with and push against the first side surface 403 of the eccentric 224, due to high pressure within the first chamber 252, as the eccentric 224 rotates relative to the HCR pin 236 until the HCR pin 236 is aligned with the first detent 408 (as shown in FIGS. 4 and 5) of the eccentric 224. When aligned with the first detent 408, the HCR pin 236 slides into the first detent 408, locking the position of the eccentric 224 relative to the fourth crankpin 218 so that the eccentric 224 rotates in unison with the fourth crankpin 218 and spins within the first end 228 of the conrod 226.

Returning to FIGS. 7 and 8, the DCV 702 may be adjusted to the low CR configuration 800 of FIG. 8 by, for example, activating an electromagnet positioned on the left side of the DCV 702 and drawing the spool 704 to the left. In the low CR configuration 800, the first oil channel 710 is fluidly coupled to the low pressure oil reservoir instead of the high pressure oil reservoir and the second oil channel 712 is fluidly coupled to the high pressure oil reservoir instead of the low pressure oil reservoir. The high pressure in each first chamber 252 is vented to the low pressure oil reservoir, the force imposed by high pressure on the HCR pin 236 eventually decreasing enough to allow the spring force exerted on the HCR pin 236 to retract the HCR pin 236 into the first chamber 252 so that the HCR pin 236 disengages from the eccentric 224 and no longer protrudes from the first inner surface 242 of the fourth crankpin 218, as shown in FIG. 3.

The disengagement of the HCR pin 236 unlocks the eccentric 224 from the fourth crankpin 218 and the eccentric 224 may be compelled to rotate around the fourth crankpin 218 due to oil shear forces between the second bearing 606 of the eccentric 224 and the fourth crankpin 212. As the eccentric 224 rotates, an end of the LCR pin 234 may protrude out of the second chamber 254 and press against the second side surface 407 of the eccentric 224 due to high pressure in the second chamber. The protrusion of the LCR pin 234 from the second chamber 254 is driven by the flow of oil from the high pressure oil reservoir, through the second oil channel 712 and into each of the first, third, and fifth main bearing journals 213, 216, and 209. As a result, oil is delivered to each second chamber 254, increasing a pressure in each second chamber 254 that pushes each LCR pin 234 outwards, overcoming an opposing spring force exerted on each LCR pin 234 by the second spring 250.

As the eccentric 224 rotates around the fourth crankpin 212 with the LCR pin 234 pressing against the second side surface 407, the LCR pin 234 may align with the second detent 410, as shown in FIGS. 4 and 5, of the eccentric 224. When aligned, the LCR pin 234 slides into the second detent 410, locking the position of the eccentric 224 to the fourth crankpin 218 so that the eccentric 224 rotates in unison with the fourth crankpin 218, spinning within the first end 228 of the conrod 226. As such, the eccentric 224 is locked in the second, low CR configuration 300 of FIG. 3.

In this way, an engine CR may be adjusted between a higher CR and a lower CR by a VCR mechanism, as depicted by the first and second configurations 200 and 300 of FIGS. 2 and 3 respectively, the VCR mechanism comprising eccentrics and locking pins. Piston height may be varied based on an orientation of an eccentric coupled to each crankpin of a crankshaft. The orientation of the eccentric may be locked to the crankpin by a first locking pin or a second locking pin, each locking pin corresponding to a different eccentric positioning that modifies the engine CR. The first locking pin may interact with a first detent in the eccentric to maintain the eccentric, as well as a piston coupled to the eccentric via a conrod, in a first position that provides the engine with the higher CR. Disengaging the first locking pin allows the orientation of the eccentric to change relative to the crankpin until second locking pin engages a second detent of the eccentric, maintaining the eccentric and the piston in a second position that lowers the CR relative to the first position. The orientation of the eccentric may be readily modified by mechanically locking the eccentric with either the first or second locking pin and relying on friction, e.g., oil shear forces, to rotate the eccentric between the first and second positions, circumventing a dependency on additional devices that increase complexity, weight, energy consumption, or undesirable noise, such as gears and motors. Arranging the eccentric on an end of the conrod distal to the piston reduces mass imbalances between moving engine components, thereby precluding use of balance shaft to compensate.

Adjustment of the locking pins between actively engaging the eccentric and retraction of the locking pins into chambers disposed in main bearing journals of the crankshaft may be implemented by a combination of hydraulic pressure communicated by engine oil reservoirs and spring force provided by extension springs coupled to the locking pins. A directional control valve may be used to control hydraulic pressure in the chambers, either increasing the pressure to overcome the spring force of the springs and driving movement of the locking pins out of the chambers and into detents of the eccentric or venting the pressure to allow the springs to withdraw the locking pins into the chambers, disengaging the locking pins from the eccentric. The directional control valve may be coupled to existing oil passages in the engine, leveraging hydraulic pressure provided by engine components, such as an engine oil pump driving oil flow through the engine block.

Figure 9:
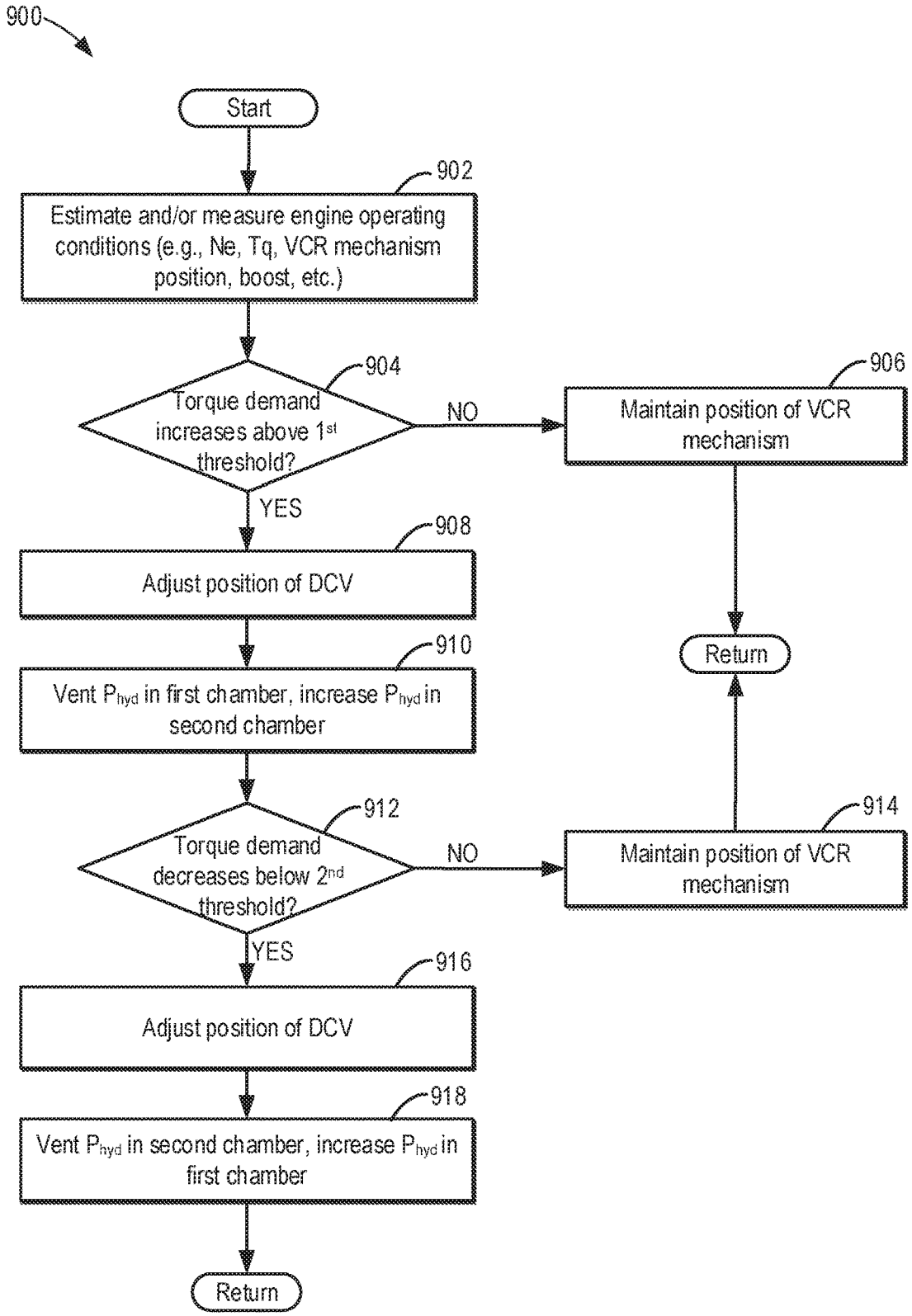
FIG. 9 shows an example of a method for adjusting a compression ratio of an engine adapted with a VCR mechanism.

An example of a method 900 for varying a CR of a VCR engine is depicted in FIG. 9. The VCR engine may be the engine 10 of FIG. 1, including a crankshaft such as the crankshaft 204 shown in FIGS. 2 and 3, and adapted with a VCR mechanism, such as the VCR mechanism 202 illustrated in FIGS. 2 and 3, actuated by a directional control valve (e.g., the DCV 702 of FIGS. 7 and 8). The VCR mechanism includes a plurality of eccentrics, each eccentric coupled to a crankpin of the crankshaft. Each eccentric may be locked in position by either a first locking pin that maintains the VCR mechanism in a higher CR configuration or a second locking pin that maintains the VCR mechanism in a lower CR configuration. The first and second locking pin are positioned on opposite sides of the eccentric, configured to be inserted into a first detent and a second detent, each disposed in opposite side surfaces of the eccentric. Movement of the first and second locking pins in and out of a first oil chamber and a second oil chamber, respectively, is controlled by the DCV which modifies hydraulic pressure in the first and second chambers by varying a position of a spool between a first position and second position, thereby regulating oil flow between the chambers and oil reservoirs in the engine. The hydraulic pressure in the oil chambers that drives motion of the locking pins in an outwards, e.g., out of the chambers, direction competes with an opposing spring force exerted on the locking pins by extension springs that pulls the locking pins in an inwards, e.g. into the chambers, direction. The engine may initially be in the higher CR configuration with the spool of the DCV in the first position to provide high fuel efficiency in response to low engine loads and speeds, e.g., during cruising or idling. The first locking pin may be engaged with the first detent of the eccentric while the second locking pin is retracted into the second chamber. Instructions for carrying out method 900 and the rest of the methods included herein may be executed by a controller, such as controller 12 of FIG. 1, based on instructions stored on a memory of the controller and in conjunction with signals received from sensors of the engine system, such as the sensors described above with reference to FIG. 1. The controller may employ engine actuators of the engine system to adjust engine operation, according to the methods described below. For example, the controller may send control signal to the DCV to adjust the oil pressure supplied to the first and second chambers by varying the position of the DCV based on a detected change in a manifold absolute pressure, as measured by a MAP sensor such as the MAP sensor 124 of FIG. 1.

At 902, the method includes estimating and/or measuring operating conditions of the VCR engine. For example, engine speed may be determined from a Hall effect sensor, such as the hall effect sensor 120 of FIG. 1, torque request may be determined based on a pedal position sensor of an accelerator pedal, such as the pedal position sensor 134 of the input device 132 of FIG. 1, boost supplied by a turbocharger may be determined based on a MAP sensor, such as the MAP sensor 124 of FIG. 1, a position of the VCR mechanism may be detected by a position sensor such as the VCR mechanism position sensor 196 shown in FIG. 1, and an inferred compression ratio (CR) of the engine may be determined based on the position of the VCR mechanism.

The method determines, at 904, if a torque demand rises above a first threshold. The first threshold may be a level of torque above which a likelihood of engine knock is increased when the engine is in the higher CR configuration. For example, the engine may have a CR of 12:1 during cruising. An operator may depress the accelerator pedal further to navigate up a hill, driving an increase in engine speed and demanding a higher boost pressure that corresponds to an amount of delivered torque that exceeds the first threshold. The controller may command reducing the CR to, as an example, 9:1 by activating an electromagnet in the DCV that shifts the DCV from a high CR position to a lower CR position.

If the torque demand does not rise above the first threshold, the method continues to 906 to maintain a current position of the DCV and VCR mechanism in the higher CR configuration. The method then returns to the start. If the torque demand increases above the first threshold, the method proceeds to 908 to adjust the position of the DCV. In one example, the method at 908 includes activating the electromagnet of the DCV (e.g., via sending an electronic control signal to the electromagnet) to slide the spool from the first position to the second position, as discussed above with reference to FIGS. 7 and 8. At 910, the method includes venting a high hydraulic pressure in the first chamber to a low pressure oil reservoir upon sliding of the spool into the second position. Releasing the pressure in the first chamber decreases the hydraulic pressure so that the spring force of the spring coupled to the first locking pin is able to retract the first locking pin into the first chamber, thereby unlocking the eccentric.

As the pressure in the first chamber decreases, the hydraulic pressure in the second chamber increases due to fluidic coupling to a high pressure oil reservoir. Oil flows into the second chamber, driving the chamber pressure high enough to overcome the spring force exerted on the second locking pin by the spring coupled to the second locking pin. The second locking pin is pushed along the outwards direction, pressing against a side surface of the eccentric as the unlocked eccentric rotated relative to the crankpin due to unidirectional oil shear forces between a bearing, positioned between the eccentric and the crankpin, and the crankpin. As the eccentric rotates, the second detent in the eccentric aligns with the second locking pin and the second locking pin slides into the second detent, locking the eccentric to the crankpin and into the lower CR configuration. The piston height is thus lowered, decreasing the engine CR.

At 912, the method includes determining if the torque demand decreases below a second threshold. The second threshold may be similar to or different from the first threshold. The second threshold may be a level of torque below which a likelihood of engine knock is decreased when the engine is in the lower CR configuration. For example, the engine may have a CR of 10:1 in the lower CR configuration. An operator may release the accelerator pedal to initiate deceleration, reducing engine speed and indicating that boost pressure may be lowered. The requested torque output may be drop below a level or torque demand that allows prioritization of fuel efficiency over power. In response, the controller may command increasing the CR to, as an example, 13:1 by activating the electromagnet in the DCV to shift the DCV from the lower CR position to the higher CR position.

Figure 10:
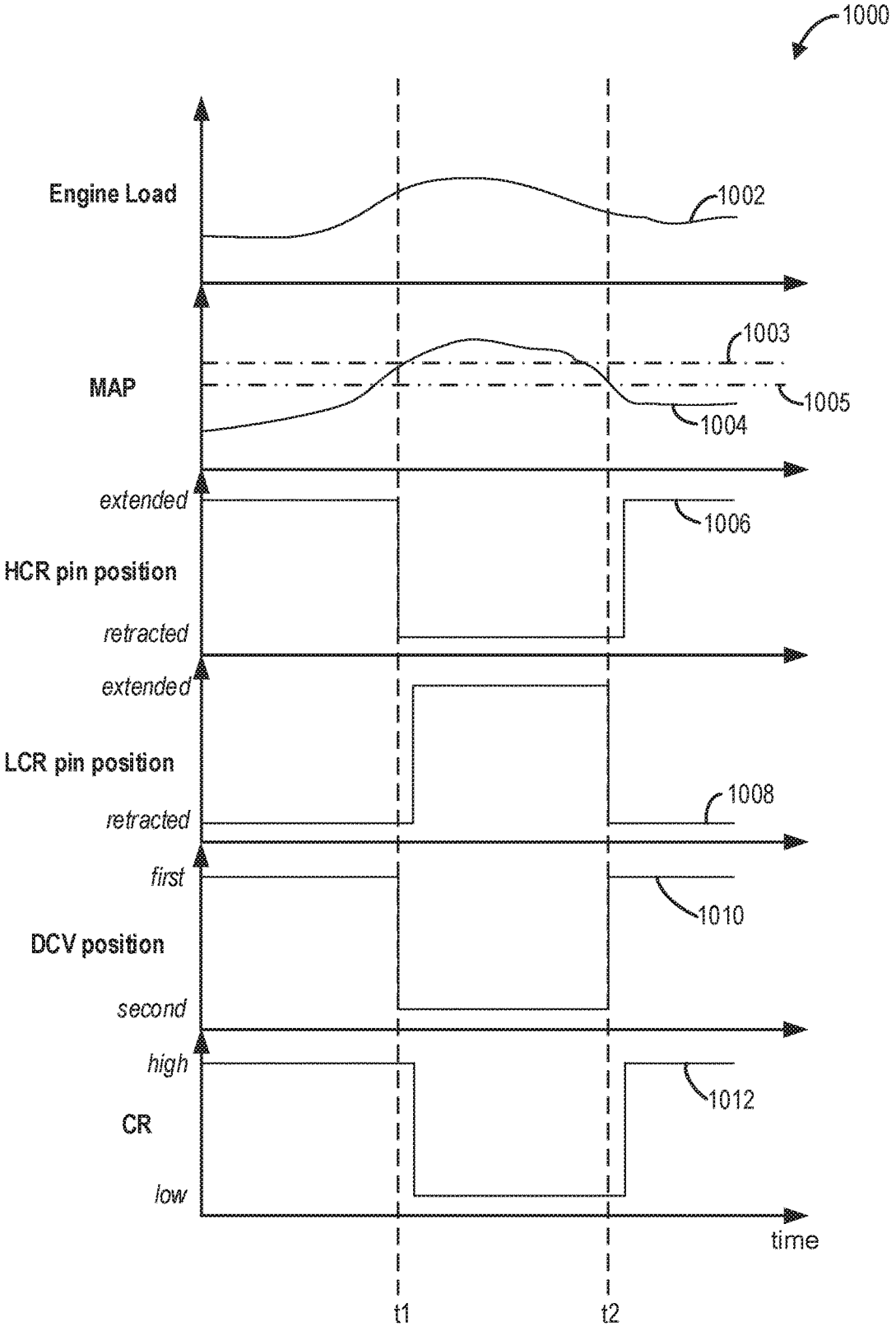
FIG. 10 shows example operations of the VCR engine during events where the compression ratio of the engine is adjusted according to engine operating conditions.

If the torque demand does not drop below the second threshold, the method continues to 914 to maintain the position of the DCV and VCR mechanism in the low CR configuration. The method then returns to the start. If the torque demand decreases below the second threshold, the method proceeds to 916 to adjust the position of the DCV via activating the electromagnet of the DCV to slide the spool from the second position to the first position. At 918, the method includes venting the high hydraulic pressure in the second chamber to the low pressure oil reservoir upon sliding of the spool into the first position. Releasing the pressure in the second chamber decreases the hydraulic pressure so that the spring force of the spring coupled to the second locking pin is able to retract the second locking pin into the second chamber, thereby unlocking the eccentric. As the pressure in the second chamber decreases, the hydraulic pressure in the first chamber increases due to fluidic coupling to the high pressure oil reservoir. Oil flows into the first chamber, driving the chamber pressure high enough to overcome the spring force exerted on the first locking pin by the spring coupled to the first locking pin. The first locking pin is pushed along the outwards direction, pressing against a side surface of the eccentric, opposite from the side surface of the eccentric that interacts with the second locking pin, as the unlocked eccentric rotates relative to the crankpin due to unidirectional oil shear forces between the eccentric bearing and the crankpin. As the eccentric rotates, the first detent in the eccentric aligns with the first locking pin and the first locking pin slides into the first detent, locking the eccentric into the higher CR configuration. The piston height is thus raised, increasing the engine CR. The method then returns to the start. Example operations of a VCR engine in a vehicle are shown in FIG. 10 in a map 1000.

The vehicle may be the vehicle 5 of FIG. 1, adapted with a VCR mechanism, e.g., the VCR mechanism 202 of FIGS. 2 and 3, coupled to a DCV. The DCV regulates hydraulic pressure in the VCR mechanism, adjusting the VCR mechanism between a higher CR configuration and a lower CR configuration. Map 1000 shows time along the x-axis and depicts engine load (plot 1002), absolute manifold pressure (MAP, plot 1004) measured in an intake manifold, a position of a high compression ratio (HCR) locking pin (plot 1006), a position of a low compression ratio locking pin (plot 1008), a position of the DCV (plot 1010), and an engine compression ratio (plot 1012). Engine load and MAP increase along the y-axis and the engine CR varies between a higher CR and a lower CR. The HCR and LCR locking pins are adjustable between an extended position, protruding from oil chambers housing the pins to engage with eccentrics that vary piston height, and a retracted position where the pins are drawn into the oil chambers and disengaged from the eccentrics. The DCV may be adjusted between a first position, corresponding to a higher CR configuration, and a second position, corresponding to a lower CR configuration, as described above with respect to FIGS. 7 and 8.

Initially, the engine load (plot 1002) and MAP (plot 1004) are at levels where fuel efficiency is prioritized over power output of the engine. As such, the engine is in the higher CR configuration with the DCV in the first position (plot 1010) so that high pressure oil is flowed to the oil chambers housing the HCR locking pins. The HCR locking pins are extended and engaged with the eccentrics (plot 1006) while the LCR locking pins are retracted (plot 1008) and disengaged and the engine CR is high (plot 1012).

At t1, the engine load increases to a level that demands an increase in boost pressure. The increase may result from a request for increased acceleration of the vehicle. The resulting MAP in the intake manifold rises above a first threshold 1003. Above the first threshold 1003, a likelihood of engine knock occurring is elevated. In response to the MAP crossing the first threshold 1003, the DCV is shifted to the second position by energizing, for example, an electromagnet that induces movement of a spool in the DCV. Adjustment of the DCV alters a hydraulic pressure of the oil chambers, decreasing a pressure in the oil chambers housing the HCR locking pins and allowing the HCR locking pins to be retracted by a force exerted on the HCR locking pin by extension springs. Retraction of the HCR locking pins allows a position of the eccentrics relative to crankpins of a crankshaft to be varied, altering a height of pistons coupled to the eccentrics via conrods.

After a short period time to allow the pressure to build, the pressure in the oil chambers housing the LCR locking pins increases sufficiently to push the LCR locking pins out of the oil chambers to engage with detents in a first side surface of the eccentrics. The engine CR switches to the lower CR when the eccentrics are locked in position by the LCR locking pins.

At t2, the engine load decreases due to, for example, downhill navigation of the vehicle. Boost demand is reduced, thus boost pressure decreases and the MAP decreases, dropping below a second threshold 1005 at t2. While the second threshold 1005 is shown to be lower than the first threshold 1003, in other examples, the second threshold 1005 may be equivalent to or higher than the first threshold 1003. The second threshold 1005 may be a level of MAP below which a torque demand is low enough that fuel efficiency may be prioritized while supplying sufficient torque. A likelihood of engine knock at the low CR of the engine is reduced. To increase fuel efficiency, the VCR mechanism may be adjusted to the high CR configuration.

The DCV is adjusted to the first position by energizing the electromagnet to slide the spool in an opposite direction from the sliding of the spool into the second position. The arrangement of the DCV in the first position vents the pressure in the oil chambers housing the LCR locking pins, allowing the LCR locking pins to be retracted into the oil chambers by the extension springs and allowing the eccentrics to rotate relative to the crankpins, altering the heights of the pistons. Concurrently, the hydraulic pressure in the oil chambers housing the HCR locking pins increases, eventually reaching a high enough pressure, a short period of time after t2, to overcome the spring force of the extension springs and pushing the HCR locking pins out of the oil chambers.

As the orientation of the eccentrics is modified, the HCR locking pins engage with detents in a second side surface of the eccentrics, opposite of the first side surface, locking the eccentrics in the high CR configuration and lowering the piston heights relative to the lower CR configuration.

In this way, a VCR mechanism may adjust a compression ratio of an engine using a mechanical system that does not include any additional gears or motors for actuation and maintains a mass balance in the engine by positioning a plurality of eccentrics at conrod ends distal to engine pistons. The engine may be adjusted between a higher CR and a lower CR by a combination of the plurality of eccentrics, configured to vary piston height, and locking pins to retain a position of the eccentrics, alternating between a first locking pin that maintains the high CR and a second locking pin that maintains the low CR. The engagement/disengagement of the locking pins with the eccentrics may be controlled by a valve that directs oil flow to vary hydraulic pressure in the VCR mechanism. The hydraulic pressure competes with forces exerted on the locking pins by springs and the hydraulic pressure may be increased to overcome the spring force to insert the locking pins into receiving detents of the eccentrics or decreased to enable retraction of the locking pins away from the eccentrics. By mechanically locking the CR of the engine and adjusting the CR based on hydraulic pressure provided by oil passages in the engine, NVH issues arising from use of complex gearing systems are precluded and the VCR mechanism does not impose additional weight, costs, or motors to the engine. The VCR mechanism is retrofittable and may be adapted to a variety of engine types and configurations.

The technical effect of configuring the engine with the VCR mechanism as disclosed herein is that a fuel economy of the engine is increased during low engine loads while sufficient power output and knock mitigation is provided during high engine loads.

In another representation a variable compression ratio (VCR) system includes a first portion with an eccentric coupled to a crankpin of a crankshaft, the eccentric configured to rotate with the crankpin when in a locked position and rotate around the crankpin when in an unlocked position, a second portion with a first locking pin configured to engage with a first receiving slot on a first side of the eccentric and a second locking pin configured to engage with a second receiving slot on a second side of the eccentric, opposite of the first side, and a valve configured to control hydraulic pressure in the second portion. In a first example of the system, the valve is adjustable between a first position and a second position, the first position configured to impose a higher pressure on the first locking pin and a lower pressure on the second locking pin and the second position configured to impose a lower pressure on the first locking pin and a higher pressure on the second locking pin. A second example of the system optionally includes the first example, and further includes, wherein the lower pressure on both the first locking pin and the second locking pin exerts a force on the first and second locking pins that is less than an opposing force exerted on the first and second locking pins by extension springs coupled to the first and second locking pins. A third example of the system optionally includes one or more of the first and second examples, and further includes, wherein the engagement of the eccentric with the first or the second locking pin maintains an orientation of the eccentrics with respect to the crankpin and disengagement of the first or the second locking pin from the eccentric unlocks the eccentric from the crankpin to vary the orientation of the eccentric.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

In one embodiment, a variable compression ratio mechanism includes an eccentric with a first detent and a second detent, the first and second detents arranged on opposite faces of the eccentric and positioned 180 degrees relative to one another around a circumference of the eccentric, the eccentric configured to be adjusted between a locked position and an unlocked position, a first locking pin configured to be inserted into the first detent of the eccentric and housed in a first oil chamber, a second locking pin configured to be inserted into the second detent of the eccentric and housed in a second oil chamber, and a valve fluidly coupled to the first oil chamber and the second oil chamber. In a first example of the mechanism, the eccentric is in the locked position when the first locking pin is engaged with the first detent or alternatively, when the second locking pin is engaged with the second detent. A second example of the mechanism optionally includes the first example, and further includes, springs coupled to each of the first locking pin and the second locking pin, the springs exerting a force on the locking pins that opposes a force exerted on the locking pins by hydraulic pressure. A third example of the mechanism optionally includes one or more of the first and second examples, and further includes, wherein the eccentric is coupled to a crankpin of a crankshaft, the crankpin extending through an aperture of the eccentric, and coupled to an end of a conrod extending between the eccentric and a piston. A fourth example of the mechanism optionally includes one or more of the first through third mechanisms, and further includes, wherein a bearing is arranged between the eccentric and the crankpin and fixedly coupled to the eccentric. A fifth example of the mechanism optionally includes one or more of the first through fourth mechanisms, and further includes, wherein the eccentric is in the locked position when an oil pressure in the first chamber is higher than an oil pressure in the second chamber and the first locking pin protrudes from the first oil chamber, the first locking pin aligned with the first detent of the eccentric. A sixth example of the mechanism optionally includes one or more of the first through fifth mechanisms, and further includes, wherein when the first locking pin is engaged with the first detent of the eccentric, a thicker portion of the eccentric is arranged above a rotational axis of the crankshaft, corresponding to a TDC position of the piston and the VCR mechanism is in a higher compression ratio configuration. A seventh example of the mechanism optionally includes one or more of the first through sixth mechanisms, and further includes, wherein the eccentric is in the locked position when an oil pressure in the second chamber is higher than an oil pressure in the first chamber and the second locking pin protrudes from the second oil chamber, the second locking pin aligned with the second detent of the eccentric. An eighth example of the mechanism optionally includes one or more of the first through seventh mechanisms, and further includes, wherein when the second locking pin is engaged with the second detent of the eccentric, a thinner portion of the eccentric is arranged above a rotational axis of the crankshaft, corresponding to a TDC position of the piston and the VCR mechanism is in a lower compression ratio configuration.

In another embodiment, a method includes, responsive to a command to adjust a compression ratio of the VCR engine, adjusting a hydraulic pressure supplied to a VCR mechanism to alternate positions of a first locking pin and a second locking pin of the VCR mechanism relative to an eccentric of the VCR mechanism, the eccentric surrounding a crankpin of a crankshaft of the VCR engine. In a first example of the method, adjusting a hydraulic pressure of the VCR mechanism includes varying a position of a valve to flow higher pressure oil to a first oil chamber arranged within the crankshaft and housing the first locking pin and fluidly couple a second oil chamber arranged within the crankshaft and housing the second locking pin to a lower pressure oil reservoir. A second example of the method optionally includes the first example, and further includes, wherein flowing higher pressure oil to the first oil chamber increases a pressure in the first oil chamber and pushes the first locking pin out of the first chamber to press against a first side surface of the eccentric rotating around the crankpin to slide the first locking pin into the first detent and lock the eccentric in a first position when the first locking pin and first detent align. A third example of the method optionally includes one or more of the first and second examples, and further includes, wherein adjusting the hydraulic pressure of the VCR mechanism includes varying the position of the valve to flow higher pressure oil to the second oil chamber and fluidly couple the first oil chamber to the lower pressure oil reservoir. A fourth example of the method optionally includes one or more of the first through third examples, and further includes, wherein flowing higher pressure oil to the second oil chamber increases a pressure in the second oil chamber and pushes the second locking pin out of the second chamber to press against a second side surface of the eccentric, the second side surface opposite of the first side surface, to slide the second locking pin into the second detent and lock the eccentric in a second position when the second locking pin and the second detent align. A fifth example of the method optionally includes one or more of the first through fourth examples, and further includes, wherein adjusting the eccentric between the first position and the second position includes disengaging the first locking and the second locking pin and enabling the eccentric to rotate 180 degrees relative to the crankpin. A sixth example of the method optionally includes one or more of the first through fifth examples, and further includes, exerting a force on each of the first locking pin and the second locking pin by a spring coupled to each of the locking pins, the spring exerting a force on the first and second locking pins to pull the first and second locking pins into the first and second oil chambers, respectively, and opposing movement of the first locking pin and second locking as compelled by oil pressure. A seventh example of the method optionally includes one or more of the first through sixth examples, and further includes, wherein reducing oil pressure in the first oil chamber or second oil chamber allows the force exerted by the spring on the first locking pin or second locking pin to overcome the force exerted by oil pressure and increasing oil pressure in the first oil chamber or second oil chamber allows the force exerted by oil pressure to overcome the force exerted by the spring on the first locking pin or the second locking pin.

In another embodiment, an engine includes a crankshaft including a plurality of crankpins, each crankpin coupled to an engine piston, a VCR mechanism including a plurality of eccentrics, each eccentric coupled to a crankpin of the plurality of the crankpins, and a plurality of locking pins including sets of two locking pins on opposite sides of each crankpin and configured to engage with a corresponding eccentric of the plurality of eccentrics, a valve configured to adjust a positioning of the plurality of locking pins, and a controller including memory with instructions stored thereon executable to actuate the valve to adjust the positions of the plurality of locking pins by varying a hydraulic pressure in the VCR mechanism to allow the plurality of eccentrics to rotate with respect to the plurality of crankpins and vary a height of the engine pistons in response to a detected change in engine speed, the height of the engine pistons corresponding to a compression ratio of the VCR engine. In a first example of the engine, the plurality of eccentrics are coupled to engine pistons by conrods extending between the pistons and the plurality of eccentrics and wherein the plurality of eccentrics are connected to ends of the conrods distal to the pistons.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A variable compression ratio (VCR) mechanism, comprising:

an eccentric with a first detent and a second detent, the first and second detents arranged on opposite faces of the eccentric and positioned 180 degrees relative to one another around a circumference of the eccentric, the eccentric configured to be adjusted between a locked position and an unlocked position;

a first locking pin configured to be inserted into the first detent of the eccentric and housed in a first oil chamber;

a second locking pin configured to be inserted into the second detent of the eccentric and housed in a second oil chamber; and a valve fluidly coupled to the first oil chamber and the second oil chamber.

2. The VCR mechanism of claim 1, wherein the eccentric is in the locked position when the first locking pin is engaged with the first detent or alternatively, when the second locking pin is engaged with the second detent.

3. The VCR mechanism of claim 1, further comprising springs coupled to each of the first locking pin and the second locking pin, the springs exerting a force on the locking pins that opposes a force exerted on the locking pins by hydraulic pressure.

4. The VCR mechanism of claim 1, wherein the eccentric is coupled to a crankpin of a crankshaft, the crankpin extending through an aperture of the eccentric, and coupled to an end of a conrod extending between the eccentric and a piston.

5. The VCR mechanism of claim 4, wherein a bearing is arranged between the eccentric and the crankpin and fixedly coupled to the eccentric.

6. The VCR mechanism of claim 4, wherein the eccentric is in the locked position when an oil pressure in the first chamber is higher than an oil pressure in the second chamber and the first locking pin protrudes from the first oil chamber, the first locking pin aligned with the first detent of the eccentric.

7. The VCR mechanism of claim 6, wherein when the first locking pin is engaged with the first detent of the eccentric, a thicker portion of the eccentric is arranged above a rotational axis of the crankshaft, corresponding to a TDC position of the piston and the VCR mechanism is in a higher compression ratio configuration.

8. The VCR mechanism of claim 4, wherein the eccentric is in the locked position when an oil pressure in the second chamber is higher than an oil pressure in the first chamber and the second locking pin protrudes from the second oil chamber, the second locking pin aligned with the second detent of the eccentric.

9. The VCR mechanism of claim 8, wherein when the second locking pin is engaged with the second detent of the eccentric, a thinner portion of the eccentric is arranged above a rotational axis of the crankshaft, corresponding to a TDC position of the piston and the VCR mechanism is in a lower compression ratio configuration.

10. A method for a variable compression ratio (VCR) engine, comprising:

responsive to a command to adjust a compression ratio of the VCR engine, adjusting a hydraulic pressure supplied to a VCR mechanism to alternate positions of a first locking pin and a second locking pin of the VCR mechanism relative to an eccentric of the VCR mechanism, the eccentric surrounding a crankpin of a crankshaft of the VCR engine.

11. The method of claim 10, wherein adjusting a hydraulic pressure of the VCR mechanism includes varying a position of a valve to flow higher pressure oil to a first oil chamber arranged within the crankshaft and housing the first locking pin and fluidly couple a second oil chamber arranged within the crankshaft and housing the second locking pin to a lower pressure oil reservoir.

12. The method of claim 11, wherein flowing higher pressure oil to the first oil chamber increases a pressure in the first oil chamber and pushes the first locking pin out of the first chamber to press against a first side surface of the eccentric rotating around the crankpin to slide the first locking pin into the first detent and lock the eccentric in a first position when the first locking pin and first detent align.

13. The method of claim 12, wherein adjusting the hydraulic pressure of the VCR mechanism includes varying the position of the valve to flow higher pressure oil to the second oil chamber and fluidly couple the first oil chamber to the lower pressure oil reservoir.

14. The method of claim 13, wherein flowing higher pressure oil to the second oil chamber increases a pressure in the second oil chamber and pushes the second locking pin out of the second chamber to press against a second side surface of the eccentric, the second side surface opposite of the first side surface, to slide the second locking pin into the second detent and lock the eccentric in a second position when the second locking pin and the second detent align.

15. The method of claim 14, wherein adjusting the eccentric between the first position and the second position includes disengaging the first locking and the second locking pin and enabling the eccentric to rotate 180 degrees relative to the crankpin.

16. The method of claim 15, further comprising exerting a force on each of the first locking pin and the second locking pin by a spring coupled to each of the locking pins, the spring exerting a force on the first and second locking pins to pull the first and second locking pins into the first and second oil chambers, respectively, and opposing movement of the first locking pin and second locking as compelled by oil pressure.

17. The method of claim 16, wherein reducing oil pressure in the first oil chamber or second oil chamber allows the force exerted by the spring on the first locking pin or second locking pin to overcome the force exerted by oil pressure and increasing oil pressure in the first oil chamber or second oil chamber allows the force exerted by oil pressure to overcome the force exerted by the spring on the first locking pin or the second locking pin.

18. The method of claim 17, wherein locking the eccentric in the first position or in the second position locks the eccentric to the crankshaft so that the eccentric rotates in unison with the crankpin as the crankshaft turns.

19. A variable compression ratio (VCR) engine, comprising:

a crankshaft including a plurality of crankpins, each crankpin coupled to an engine piston;

a VCR mechanism including a plurality of eccentrics, each eccentric coupled to a crankpin of the plurality of the crankpins, and a plurality of locking pins including sets of two locking pins on opposite sides of each crankpin and configured to engage with a corresponding eccentric of the plurality of eccentrics;

a valve configured to adjust a positioning of the plurality of locking pins; and a controller including memory with instructions stored thereon executable to:

actuate the valve to adjust the positions of the plurality of locking pins by varying a hydraulic pressure in the VCR mechanism to allow the plurality of eccentrics to rotate with respect to the plurality of crankpins and vary a height of the engine pistons in response to a detected change in engine speed, the height of the engine pistons corresponding to a compression ratio of the VCR engine.

20. The VCR engine of claim 19, wherein the plurality of eccentrics are coupled to engine pistons by conrods extending between the pistons and the plurality of eccentrics and wherein the plurality of eccentrics are connected to ends of the conrods distal to the pistons.

* * * * *